US006595264B2

(12) United States Patent
Lutz-Nivet et al.

(10) Patent No.: US 6,595,264 B2
(45) Date of Patent: Jul. 22, 2003

(54) METHOD OF MANUFACTURING A TUBE-AND-PLATE STRUCTURE OF METAL-MATRIX COMPOSITE MATERIAL

(75) Inventors: Martine Lutz-Nivet, Mandelieu (FR); Gilles Pommatau, Mandelieu (FR); Dominique Giraud, Callian (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/153,810

(22) Filed: May 24, 2002

(65) Prior Publication Data

US 2002/0174969 A1 Nov. 28, 2002

(30) Foreign Application Priority Data

May 25, 2001 (FR) ..... 01 06882

(51) Int. Cl.[7] ..... B22D 19/00
(52) U.S. Cl. ..... 164/98; 164/108; 164/113
(58) Field of Search ..... 164/98, 108, 113

(56) References Cited

U.S. PATENT DOCUMENTS 4,671,336 A 6/1987 Anahara et al. ..... 164/110
5,542,471 A * 8/1996 Dickinson ..... 165/170
5,727,511 A * 3/1998 Omura et al. ..... 123/193.2
6,048,432 A 4/2000 Ecer ..... 156/263
6,113,377 A * 9/2000 Clark ..... 425/195
6,216,763 B1 4/2001 Ruehl et al. ..... 164/98

FOREIGN PATENT DOCUMENTS

EP 0 513 685 A1 11/1992
EP 0 610 020 A1 8/1994
EP 0 882 534 A1 12/1998

* cited by examiner

*Primary Examiner*—Tom Dunn
*Assistant Examiner*—I.-H. Lin
(74) *Attorney, Agent, or Firm*—Sughrue Mion, PLLC

(57) ABSTRACT

A method of manufacturing a tube-plate structure of metal-matrix composite material in which a single mold is used having a first fiber preform of shape comparable to that of the tube, a second fiber preform of shape comparable to that of the plate, and a third fiber preform surrounding the first fiber preform where it is adjacent to the second fiber preform all placed therein. Thereafter, a metal or a metal alloy is injected into the mold along the axis of the tube via the face of the second preform that is remote from the first preform. This provides a monolithic structure that presents a high degree of thermo-mechanical stability.

13 Claims, 1 Drawing Sheet

METHOD OF MANUFACTURING A TUBE-AND-PLATE STRUCTURE OF METAL-MATRIX COMPOSITE MATERIAL

TECHNICAL FIELD

The invention relates to a method of manufacturing a structure comprising at least one tube and at least one plate of a metal-matrix composite material, the tube and the plate being assembled to each other.

Such a method can be used in particular for manufacturing structures for use in the space industry, such as trellis structures used for supporting on-board optical instruments of the space telescope type, etc.

PRIOR ART

When optical instruments such as space telescopes are mounted on board space vehicles, the instruments are generally mounted on trellis structures.

As a general rule, trellis structures comprise one or more mutually parallel plates and a plurality of tubes interconnecting the plates in various directions so as to provide an assembly having a high level of dimensional stability.

In addition to these requirements for stability, the tubes and the plates constituting trellis structures that support optical instruments fitted to space vehicles need to present appropriate mechanical characteristics together with mass that is as low as possible. This often leads designers of such space vehicles to use metal-matrix composite materials for making the tubes and the plates of trellis structures.

More precisely, the tubes and the plates are usually made separately, by injecting a metal alloy into a mold containing a preform of woven fibers. The tubes and the plates are then assembled together using various techniques such as adhesive, screw fastening, or brazing.

Nevertheless, those various assembly techniques all suffer from significant drawbacks.

Thus, when the tubes and the plates are assembled together by means of adhesive, the different material inserted in this way between the pieces constitutes a source of thermo-mechanical instability, in particular because of the poor stiffness and the affinity for water of adhesive. In addition, that type of assembly gives rise to difficulties of implementation associated, for example, with the needs for surface treatment and for the adhesive to have time to polymerize.

When the tubes and the plates are assembled together by screw fastening, thermo-mechanical instability is also imparted because of friction and the micro-slippage that occurs between the pieces. In addition, adding screws and washers increases the overall mass of the structure which is undesirable for use in space.

Finally, when the tubes and the plates are assembled together by brazing, difficulties of implementation are encountered because of the respectively cylindrical and plane shapes of the pieces to be assembled together.

As illustrated in document EP-A-0 610 620, it is known to assemble two steel tubes together in a T-configuration by molding an aluminum or aluminum alloy shell around the junction zone between the two tubes.

SUMMARY OF THE INVENTION

A particular object of the invention is to provide a method of manufacturing a structure comprising at least one tube and at least one plate of metal-matrix composite material, while avoiding the drawbacks of existing methods and making it possible, in particular, to avoid imparting any thermo-mechanical instability to the junction between the tube and the plate.

According to the invention, this result is achieved by means of a method of manufacturing a structure comprising at least one tube and at least one plate of metal-matrix composite material that are connected to each other, the method comprising the following steps in succession:

- placing a first fiber preform having substantially the shape of the tube, a second fiber preform having substantially the shape of the plate, and a third fiber preform surrounding an end of the first fiber preform adjacent to the second fiber preform in a cavity of a single mold; and
- injecting a metal or a metal alloy into the cavity of the mold.

Implementing this method makes it possible to avoid having interfaces between the tubes and the plates, where such interfaces are to be found in all of the prior art techniques. This preserves the thermo-mechanical stability of the structure. In addition, there is a saving in mass compared with the technique of assembly by means of screw fastening, and there is a simplification of implementation compared with the technique of assembly by means of adhesive. In addition, making a plurality of identical pieces using the same mold gives rise to a reduction in cost.

In the commonest case where the tube is hollow, a mandrel is also placed in the mold inside the first fiber preform, the shape of the mandrel being complementary to the inside of the tube.

In a preferred implementation of the invention, the third fiber preform is made in the form of two half-shells, each having the shape of a half-ring.

Advantageously, the metal or metal alloy is injected into the cavity of the mold substantially along a longitudinal axis of the first fiber preform via a face of the second fiber preform remote from the first fiber preform.

In addition, and preferably, the first, second, and third fiber preforms are made by draping so that some of the fibers in each of the fiber preforms are substantially in alignment when the preforms are placed in the mold.

BRIEF DESCRIPTION OF THE DRAWING

A preferred embodiment of the invention is described below by way of non-limiting illustration with reference to the accompanying drawing, in which the sole figure is a diagram in partial section of a mold for making a structure comprising a tube and a plate by means of the method of the invention, and also showing the fiber preforms and the mandrel used for implementing the method.

DETAILED DESCRIPTION OF A PREFERRED EMBODIMENT OF THE INVENTION

Figure 1:
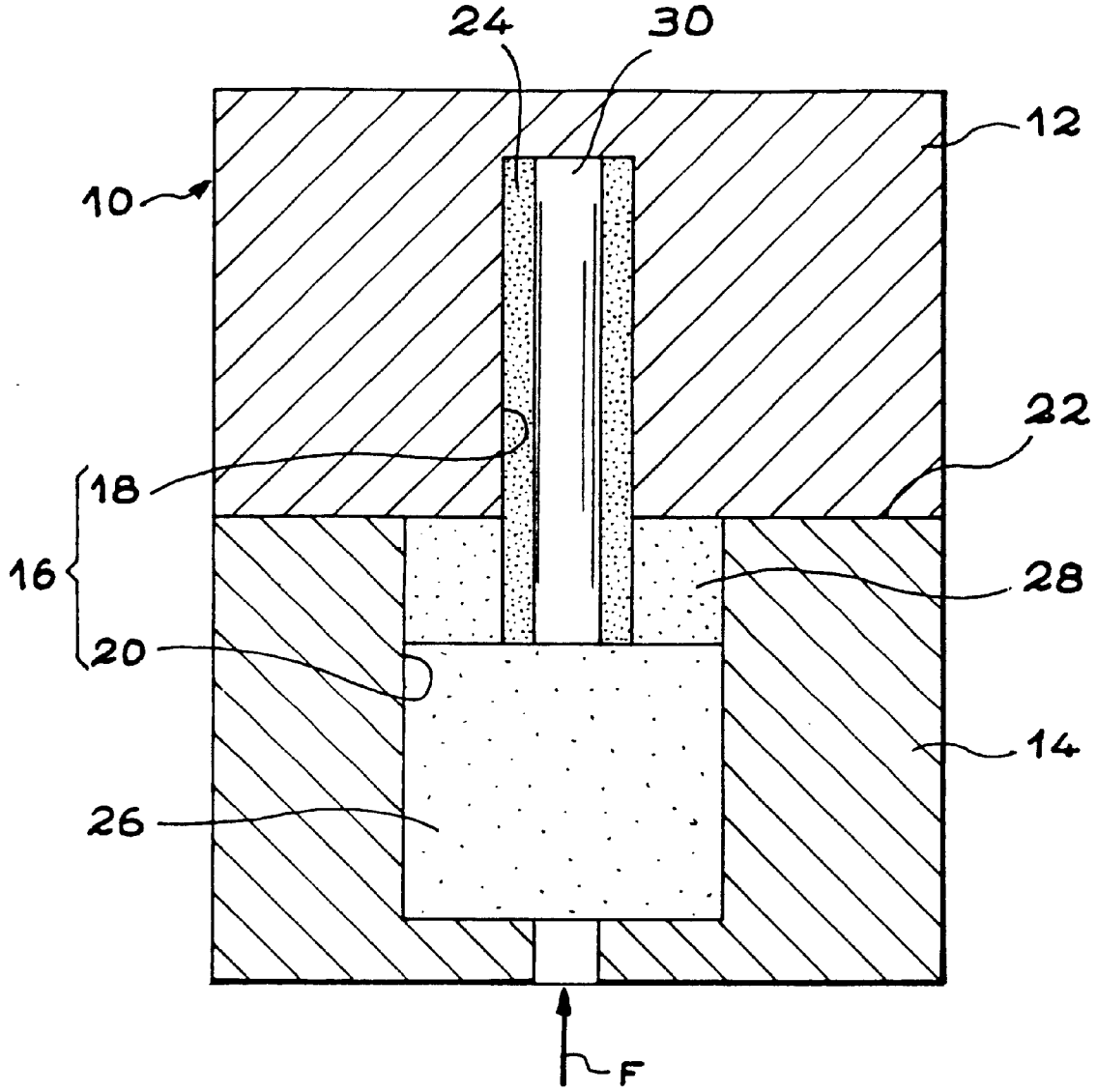

The embodiment shown by way of example in the sole figure relates to manufacturing a structure out of a metal-matrix composite material, the structure comprising a single hollow tube and a single plate. Nevertheless, the invention is not limited to manufacturing this particular type of structure, but relates more generally to manufacturing any metal-matrix composite material structure comprising one or more tubes and one or more plates assembled together. In addition, the invention can be used equally well, both when the tubes are hollow, as is usually the case, and when the tubes are solid, i.e. when the tubes are replaced by rods.

In accordance with the invention, the tube and the plate of the structure to be manufactured are made as a single piece by molding, with an annular reinforcing piece being incorporated in the structure to surround the portion of the tube that is adjacent to the plate and that also forms an integral part of the structure.

In the embodiment shown, the metal-matrix composite material structure is manufactured in a single mold 10 made up of two portions 12 and 14. The first portion 12 of the mold 10 serves essentially to make the tube while the second portion 14 serves essentially to make the plate.

The inside of the mold 10 defines a cavity 16 having a first fraction 18 formed in the portion 12 of the mold and a second fraction 20 formed in the portion 14 of the mold.

The first fraction 18 of the cavity 16 is complementary in shape to the outside shape of the tube that is to be made. In other words, the fraction 18 of the cavity is in the form of a cylindrical recess whose diameter is equal to the outside diameter of the tube and whose length is equal to the length of that portion of the tube which is situated outside the annular reinforcing piece that surrounds the tube in its junction zone with the plate.

The second fraction 20 of the cavity 16 is complementary in shape to the outside shape of the plate that is to be made and of the annular reinforcing piece which surrounds the tube in its junction zone with the plate. The join plane 22 between the two fractions 18 and 20 of the cavity 16 is thus located flush with the face of the annular reinforcing piece that is remote from the plate.

In accordance with the invention, the mold cavity 16 receives a first fiber preform 24 having substantially the shape of the tube that is to be made, a second fiber preform 26 having substantially the shape of the plate that is to be made, and a third fiber preform 28 having substantially the shape of the annular reinforcing piece surrounding the tube in its zone adjacent to the plate.

More precisely, the first fiber preform 24 is placed in the fraction 18 of the cavity and one of its ends projects into the second fraction 20 of the cavity. The second fiber preform 26 is placed in the second fraction 20 of the cavity so that the above-mentioned end of the first fiber preform 24 presses against it. Finally, the third fiber preform 28 is also placed in the second fraction 20 of the cavity, around the projecting portion of the first fiber preform 24 and pressing against the second fiber preform 26.

To facilitate implementation, the third fiber preform 28 is preferably made in the form of two half-shells, each forming half a ring.

Each of the fiber preforms 24, 26, and 28 is constituted by long fibers of nature and orientation selected depending on the mechanical characteristics desired for the structure that is to be manufactured. These selections are performed by the person skilled in the art merely by implementing conventional knowledge. They therefore do not form part of the invention.

Nevertheless, in order to improve the mechanical strength of the piece obtained by the method of the invention, the orientations of the fibers in the various preforms 24, 26, and 28 are advantageously determined in such a manner that some of the fibers in each of the preforms are substantially in alignment from one preform to another when the preforms are placed in the cavity 16 of the mold 10.

In each of the preforms 24, 26, and 28, the fibers are assembled together by any appropriate means. One assembly technique consists in particular in draping a certain number of dry pieces of cloth made using the desired fibers one on another, and in bonding the pieces of cloth together, e.g. by stitching, and then in compacting the resulting preform so as to obtain the desired fiber density.

In the embodiment shown, relating to making a hollow tube, a mandrel 30 is also placed in the mold, inside the first fiber preform 24, the shape of the mandrel 30 being complementary to the inside of the tube that is to be made.

During the following step, a metal or metal alloy selected by the person skilled in the art so as to obtain the characteristics desired for the structure that is being made is injected into the cavity 16 of the mold 10. This selection is the result merely of implementing conventional knowledge for the person skilled in the art. It does not form part of the invention.

As represented diagrammatically by an arrow F in the sole figure, the metal or metal alloy is injected into the cavity 16 via an orifice 32 formed in the portion 14 of the mold 10. More precisely, the orifice 32 opens out into the fraction 20 of the cavity on the common longitudinal axis of the fraction 18 of the cavity and of the first fiber preform 24, against one of the faces of the second fiber preform 26, specifically the face that is remote from the first fiber preform 24 and from the fraction 18 of the cavity.

Injection parameters (temperature, pressure, etc.) are determined by the person skilled in the art taking account in particular of the thermal inertia and the shape of the structure. This data is implemented merely on the basis of conventional knowledge. It therefore does not form part of the invention.

Once the metal or metal alloy has been injected and the structure has solidified, the mold 10 is opened.

In accordance with the invention, the structure extracted from the mold is a single piece which integrates the tube, the plate, and the reinforcing piece without any discontinuity. In particular, there is no interface between different materials, unlike comparable structures in the prior art. This guarantees a high degree of thermo-mechanical stability.

Furthermore, the resulting structure is lighter in weight than are prior art structures in which the tube and the plate are assembled together by screw fastening.

In addition, the structure is manufactured merely by performing a molding operation, i.e. implementing the method of the invention is significantly more simple than implementing prior art methods whereby the tube and the plate are assembled together by adhesive or by welding.

Naturally, when the structure to be made comprises a plurality of tubes and/or a plurality of plates, the mold and the fiber reinforcement need to be modified accordingly.

What is claimed is:

1. A method of manufacturing a structure comprising at least one tube and at least one plate of metal-matrix composite material that are connected to each other, the method comprising the following steps in succession:

placing a first fiber preform having substantially the shape of the tube, a second fiber preform having substantially the shape of the plate, the first and second fiber preforms placed adjacent each other, and a third fiber preform surrounding an end of the first fiber preform adjacent to the second fiber preform in a cavity of a single mold; and injecting a metal or a metal alloy into the cavity of the mold.

2. A method according to claim 1, applied to the case where the tube is hollow, in which a mandrel is also placed in the mold inside the first fiber preform, the mandrel being complementary in shape to the inside of the tube.

3. A method according to claim 1, in which the third fiber preform is made in the form of two half-shells, each having the shape of a half-ring.

4. A method according to claim 1, in which the metal or metal alloy is injected into the cavity of the mold substantially along a longitudinal axis of the first fiber preform via a face of the second fiber preform remote from the first fiber preform.

5. A method according to claim 1, in which the first, second, and third fiber preforms are made by draping so that some of the fibers in each of the fiber preforms are substantially in alignment when the preforms are placed in the mold.

6. A method of manufacturing a structure comprising at least one tube and at least one plate of metal-matrix composite material that are connected to each other, the method comprising the following steps:

placing a first fiber preform having a shape of a tube and a second fiber preform having a shape of a plate in a cavity of a mold, one end surface of the first fiber preform abutting a first portion of one end surface of the second fiber preform; and injecting a metal or a metal alloy into the cavity of the mold so as to form the one tube and one plate of matrix composite material.

7. The method according to claim 6, further comprising the step of placing a third fiber preform in the cavity of the mold prior to injecting the metal or metal alloy, so that when the first, the second, and the third fiber preforms are placed in the mold, the third fiber preform surrounds an end of the first fiber preform having the one end surface.

8. The method according to claim 7, wherein one end surface of the third fiber preform abuts a second portion of the one end surface of the second fiber preform.

9. The method according to claim 7, wherein the third fiber preform is made in the form of two half-shells, each having the shape of a half-ring.

10. The method according to claim 6, applied to the case where the tube is hollow, and comprising the step of placing a mandrel in the mold inside the first fiber preform, the mandrel being complementary in shape to the inside of the tube.

11. The method according to claim 6, wherein the metal or metal alloy is injected into the cavity of the mold so as to flow about the first and the second preforms.

12. The method according to claim 6, wherein the metal or metal alloy is injected into the cavity of the mold substantially along a longitudinal axis of the first fiber preform via a face of the second fiber preform remote from the first fiber preform.

13. The method according to claim 6, wherein the first and second fiber preforms are made by draping so that some of the fibers in each of the fiber preforms are substantially in alignment when the preforms are placed in the mold.

* * * * *